US006659057B2

(12) United States Patent
Billetdeaux

(10) Patent No.: US 6,659,057 B2
(45) **Date of Patent: *Dec. 9, 2003**

(54) SMALL FOUR-CYCLE ENGINE HAVING COMPRESSION RELIEF TO FACILITATE CRANKING

(75) Inventor: Michael Billetdeaux, Waukesha, WI (US)

(73) Assignee: MTD Products Inc, Valley City, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/167,143

(22) Filed: Jun. 11, 2002

(65) Prior Publication Data

US 2002/0148426 A1 Oct. 17, 2002

Related U.S. Application Data

(62) Division of application No. 09/499,973, filed on Feb. 8, 2000, now Pat. No. 6,401,678.

(51) Int. Cl.[7] ..... F01L 13/08
(52) U.S. Cl. ..... 123/182.1
(58) Field of Search ..... 123/182.1, 90.23

(56) References Cited

U.S. PATENT DOCUMENTS 3,451,213 A * 6/1969 Lang ..... 123/182.1
4,651,687 A 3/1987 Yamashita et al.
4,977,868 A 12/1990 Holschuh
4,991,551 A 2/1991 Terai et al.
5,706,769 A 1/1998 Shimizu
5,738,062 A 4/1998 Everts
5,884,593 A 3/1999 Immel et al.
5,943,992 A 8/1999 Kojima et al.

FOREIGN PATENT DOCUMENTS

JP 63-302116 12/1988

* cited by examiner

*Primary Examiner*—Andrew M. Dolinar
(74) *Attorney, Agent, or Firm*—Brouse McDowell; Roger D. Emerson; Timothy D. Bennett

(57) ABSTRACT

A compression relief mechanism for a small four-cycle engine to facilitate cranking. The engine has a single cam actuating both the intake and exhaust valves. The cam has a primary cam surface and a boss extending from its side. The exhaust valve cam follower engages only the primary cam surface. The intake valve cam follower has a first cam follower surface engaging only the primary cam surface and a secondary cam engagement surface engaging only the boss to open the intake valve during a predetermined portion of the engine's compression cycle. The opening of the intake valve during the compression cycle provides compression relief facilitating cranking. The secondary cam follower surface may be provided on either the intake or exhaust cam follower to open either the intake or exhaust valve during the compression cycle to provide the desired compression relief during cranking. In an alternate embodiment, the secondary cam surface is displaced by centrifugal force to a location inhibiting the secondary cam engagement surface from engaging the secondary cam surface at normal engine operating speeds.

6 Claims, 7 Drawing Sheets

Fig. 12
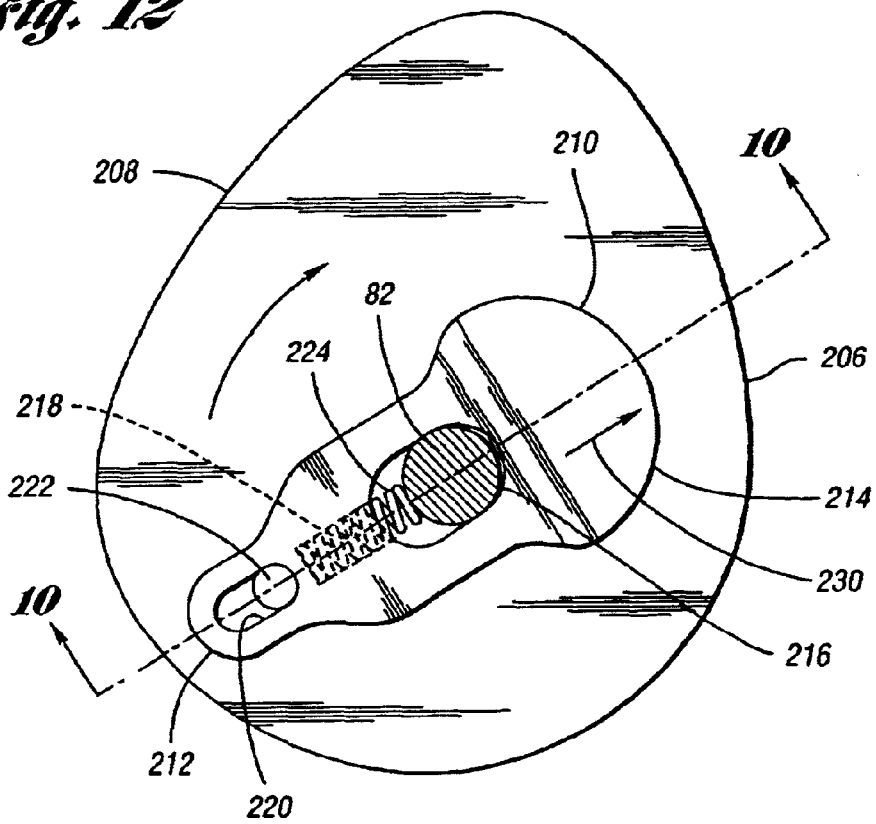
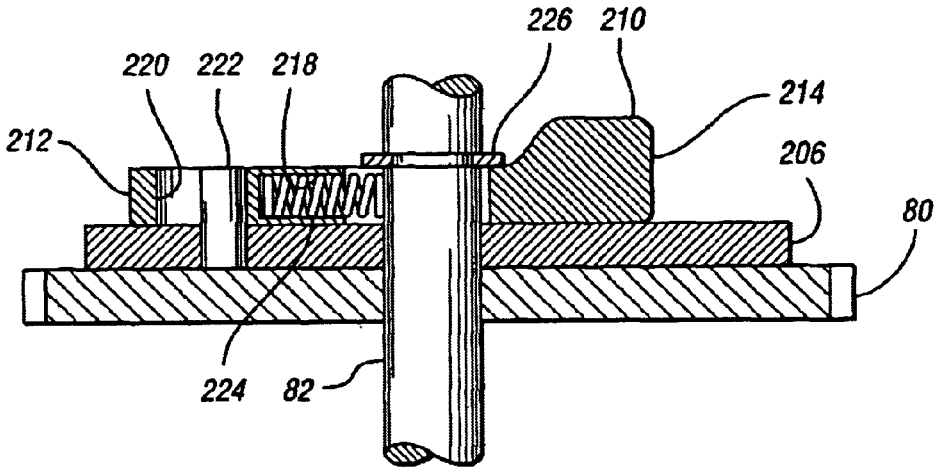
Fig. 13

SMALL FOUR-CYCLE ENGINE HAVING COMPRESSION RELIEF TO FACILITATE CRANKING

This is a divisional of application Ser. No. 09/499,973 filed on Feb. 08, 2000, now U.S. Pat. No. 6,401,678 B1.

TECHNICAL FIELD

This invention is related to small four-cycle internal combustion engines and in particular to a compression relief mechanism to facilitate engine cranking.

BACKGROUND ART

Small internal combustion engines have found wide acceptance in garden implements such as line trimmers and leaf blowers and power tools such as chain saws. Initially, small two-cycle engines were used for these applications. However, two-cycle engines have well recognized exhaust emission problems that often make them unacceptable for their use in engines that must comply with exhaust emission regulations such as the California Air Resource Board and the Federal Environmental Protection Agency ("EPA") regulations.

Limitations on exhaust emissions of carbon monoxide, hydrocarbons and nitrogen oxide that will be required in the near future cannot feasibly be met by outdoor power tools powered by two-cycle internal combustion engines. Four-cycle internal combustion engines in contrast provide a distinct advantage in that they are capable of meeting the new exhaust regulations and are quieter compared to a comparable two-cycle engines.

A problem currently being faced with the small four-cycle engine is the force required to crank them to start. Since there is no substantial overlap between the exhaust and fuel intake cycles of a four-cycle engine, the force required to overcome the compression cycle of the four-cycle engines becomes much higher. This problem was recognized by the prior art and various mechanisms have been disclosed to reduce the manual force required to overcome the compression stroke. For example, Yamashita, et al in U.S. Pat. No. 4,651,687; Holsehub in U.S. Pat. No. 4,977,868; Teral, et al in U.S. Pat. No. 4,991,551; and Kojima, et al in U.S. Pat. No. 5,948,992 all teach pressure release mechanisms deactivated by centrifugal force when the engine reaches operating speed. These mechanisms require moving parts and are equally actuated during the exhaust as well as the compression cycles keeping the exhaust valve partially open during the intake stroke as well.

DISCLOSURE OF INVENTION

The invention is an improved compression relief mechanism for small four-cycle engines of the type having a single cam actuating the exhaust and intake valves. The invention comprises a second cam surface provided on the single cam and either the intake valve cam follower or the exhaust valve follower has a second cam engagement surface which engages the second cam surface to partially open either the intake or the exhaust valve during the compression cycle to effect a compression relief reducing the force required to crank the engine.

A first object of the invention is to provide a compression relief mechanism having no moving parts.

Another object of the invention is to provide a compression relief mechanism for a four-cycle engine which is actuated only during the compression cycle.

Another object of the invention is to provide a second cam surface provided on single cam engageable with a second cam engagement surface on either the intake valve cam follower or the exhaust valve cam follower.

Still another object of the invention is to provide a boss extending from the side of the single cam lobe which provides the second cam surface and the cam follower has a second cam engagement surface which engages the boss to partially open either the intake or exhaust valve during a predetermined period during the compression cycle.

Yet another object of the invention is a mechanism for disabling the engagement of secondary cam engagement surface with the secondary cam surface at normal engine operating speeds.

These and other objects of the invention will become more apparent from a reading the detailed description of the preferred embodiment in conjunction with the appended drawings.

BRIEF DESCRIPTION OF DRAWINGS

FIG. 12 is a front view of an alternate embodiment of the invention; and

FIG. 13 is a cross-sectional view of the alternate embodiment shown on FIG. 12.

BEST MODE FOR CARRYING OUT THE INVENTION

Figure 1:
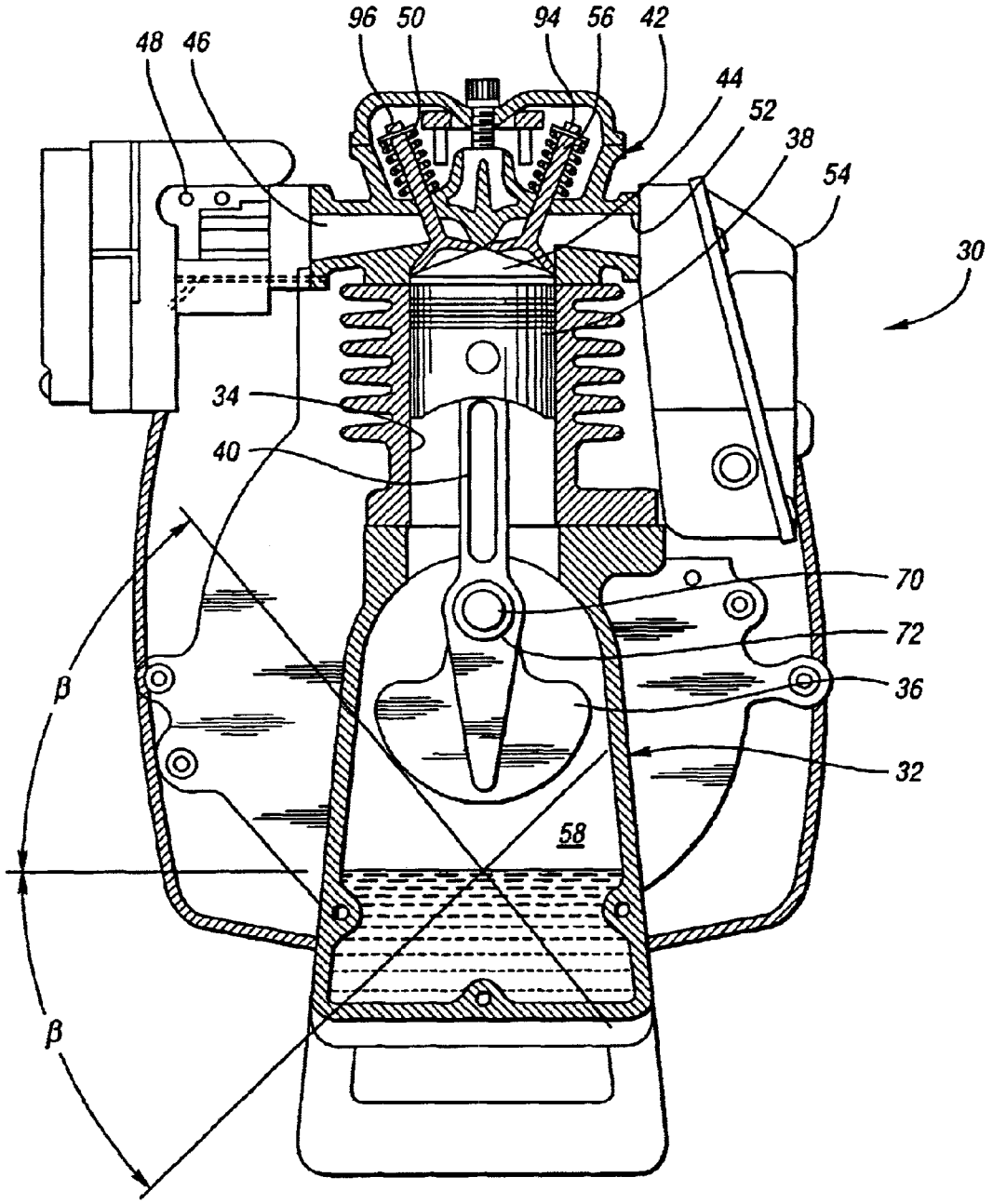
FIG. 1 is a cross-sectional side elevation of a single piston four-cycle gasoline engine.

FIG. 1 illustrates a lightweight, single piston four-cycle internal combustion engine incorporating the compression relief mechanism. This internal combustion engine is of the type disclosed in U.S. Pat. No. 5,738,062 issued to Everts on Apr. 14, 1998, which is incorporated herein by reference. These engines are relatively lightweight and may be incorporated on various types of hand-held devices such as known in the art.

Figure 2:
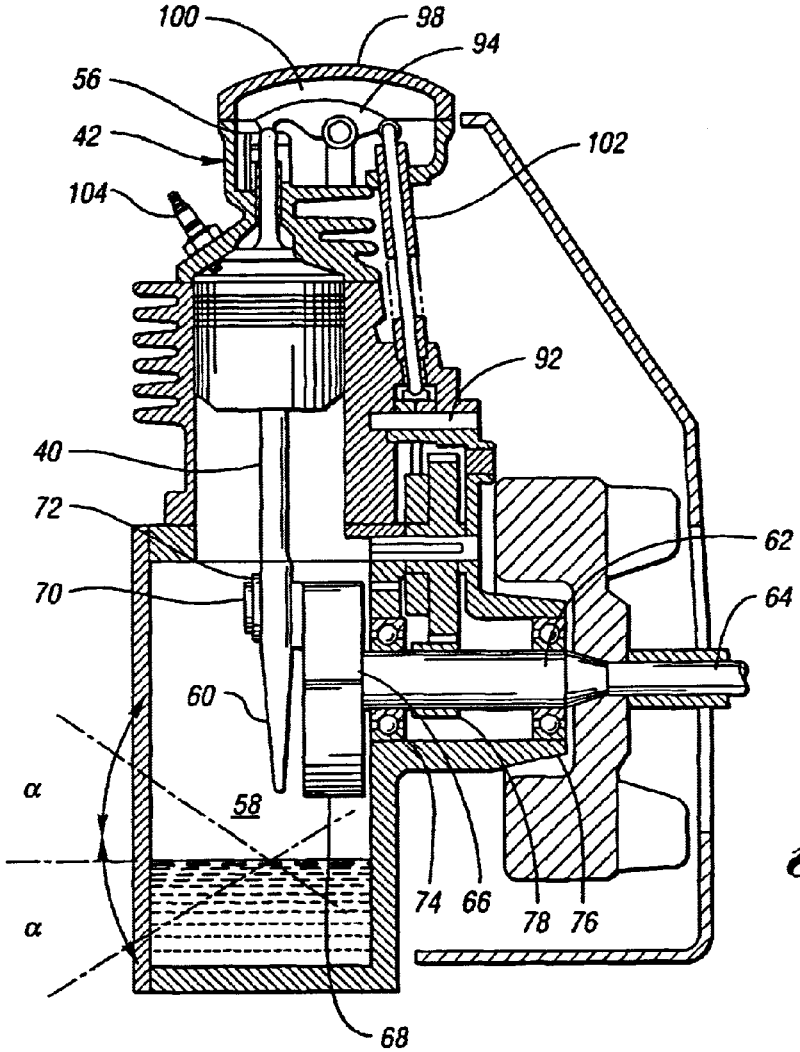
FIG. 2 is a side cross-sectional view of the engine shown in FIG. 1.

FIG. 2 is a side cross-sectional view of the four-cycle internal combustion engine 30. The engine 30 has a lightweight aluminum housing which has an engine block 32. The engine block 32 has a cylindrical piston bore 34 receiving a reciprocating piston 38. A crankshaft 36 is rotatably mounted within the engine block in a conventional manner. The piston 38 reciprocates within the piston bore 34 and is connected to the crankshaft by connecting rod 48. A cylinder head 42 is attached to the engine block 32 and defines in conjunction with the piston bore 34 and the piston 38 a combustion chamber 44. Cylinder head 42 is provided with an intake port 46 coupled to a carburetor 48 which provides a combustible air/fuel mixture. The carburetor 48 is intermittently connected to the combustion chamber 44 via an intake valve 50. Cylinder head 42 also has an exhaust port 52 connected to the combustion chamber 44 via an exhaust valve 56.

Engine block 32 is part of the housing that provides an enclosed oil reservoir 58. The oil reservoir 58 is relatively deep so that ample clearance between the crankshaft and the level of the oil during normal use in which the engine may be tilted from the vertical by 20° or more. As illustrated in FIG. 2, the crankshaft 36 is cantilevered and is provided with an axial shaft 62 having an output end 64 adopted to be coupled to a tool or implement. The opposite end of the shaft 62 is coupled to a crank 70 having an appropriate counterweight 68. Crank 70 cooperates with a series of roller bearing 72 mounted in the connecting rod 48 to rotate the crankshaft 36 with the reciprocation of the piston 38. The axial shaft 62 of the crankshaft 36 is rotatably attached to the engine block 32 by conventional bearings 74 and 76. A cam shaft drive gear 78 is attached to the crankshaft 36 intermediate bearings 74 and 76.

Figure 3:
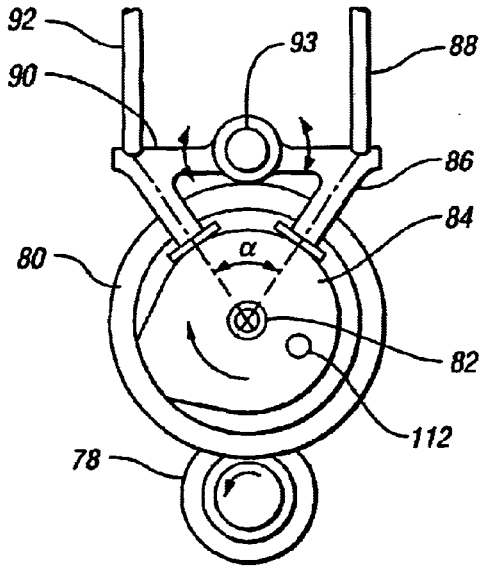
FIG. 3 is an enlarged schematic illustrating the cam lobe and cam follower mechanisms.

The camshaft device and valve lifter mechanism of the four-cycle engine shall be discussed with reference to FIGS. 2 and 3. Drive gear 78 attached to the crankshaft engages a cam gear 80 journalled to the engine block 32 by a journal 33. Cam gear 80 rotates the camshaft assembly 82 having a single cam 84 at one-half the rotational speed of the crankshaft as is known in the art. As shown in FIG. 3, the cam 84 is engaged by an intake valve cam follower 86 and an exhaust valve cam follower 90. Intake valve cam follower 86 actuates the intake valve 80 by means of push rod 88 and rocker arm 96 while exhaust valve cam follower 90 actuates the exhaust valve 56 by means of push rod 92 and rocker arm 94. The cam followers 86 and 90 are pivotably connected to the engine block 32 by means of pivot pin 93. The intake valve cam follower 86 and the exhaust valve cam follower are oriented to open the intake valve 50 during the intake engine cycle and to open the exhaust valve 56 during the engine's exhaust cycle in a conventional manner.

A valve cover 98 is attached to the cylinder head 42 and the pair of push rod tubes surround the intake and exhaust push rods 88 and 92, respectively, in order to prevent the entry of dirt and other contaminants from entering into the engine block 32. A spark plug 104 is mounted in a threaded spark plug mounting bore provided in the cylinder head. The spark plug is periodically energized to ignite the air fluid mixture in the combustion chamber 44 during the combustion cycle of the engine. The engine 30 operates in a conventional four-cycle mode.

Figure 4:
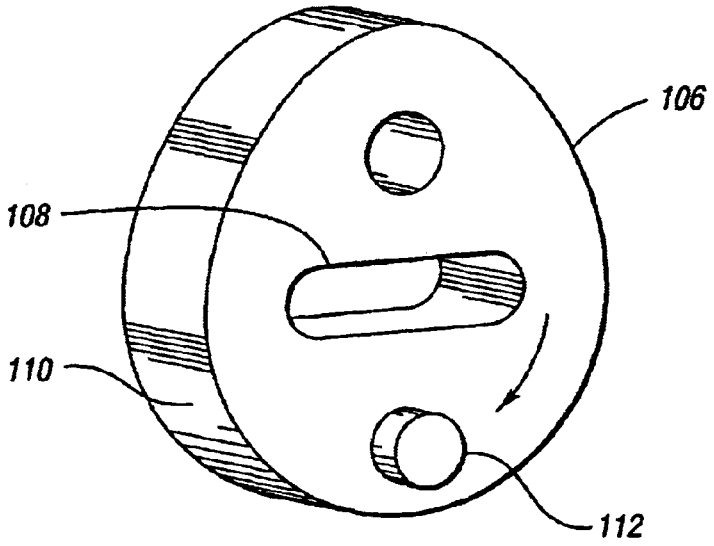
FIG. 4 is a perspective of the cam.
Figure 5:
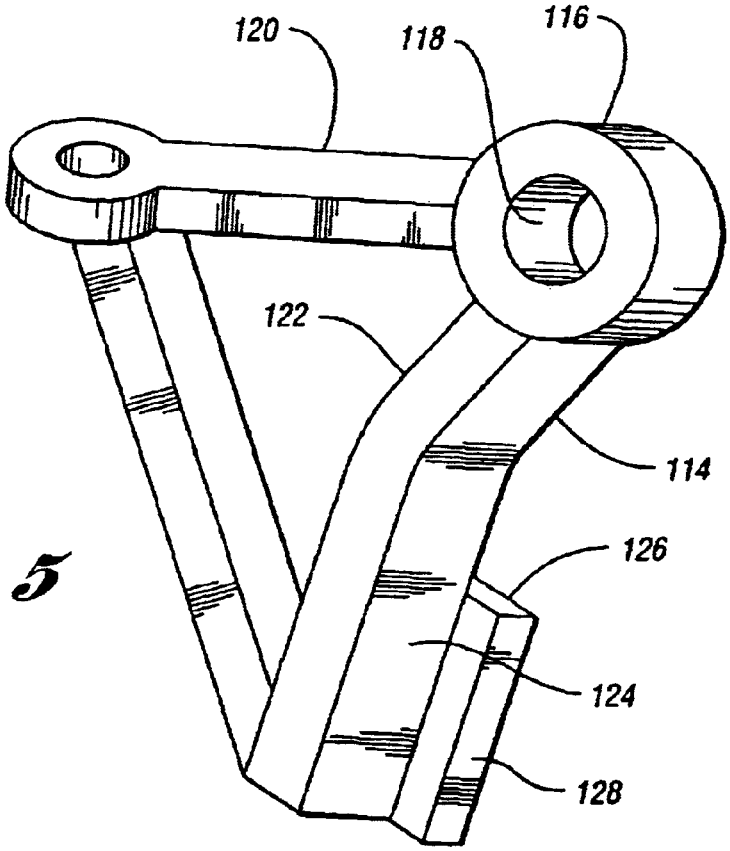
FIG. 5 is a perspective of the intake valve cam follower.
Figure 6:
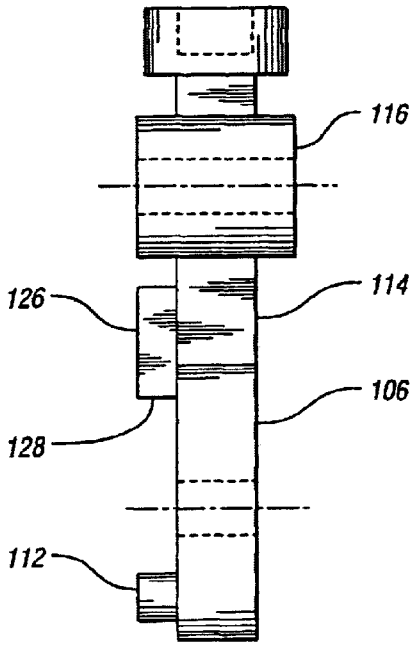
FIG. 6 is a schematic showing the primary cam engagement surfaces of the intake cam follower in contact with the cam surface.

The details of the cam 84 and the intake valve cam follower 86 which provide a desired compression relief to make the engine easier to manually crank, such as by a recoil starter, is shown in FIGS. 4 and 5. FIG. 4 shows a cam 106 corresponding to cam 84 shown in FIG. 3. Cam 106 has a mounting slot 108 which locks the rotation of the cam to the rotation of the cam gear 80, a primary cam surface 110 and a boss 112 which protrudes from the side of the cam and which provides a secondary cam surface. The cam follower 114 shown in FIG. 5 which corresponds to the intake valve cam follower 86 has a pivot boss 116. The pivot boss 116 has a pivot bore 118 by means of which it is journalled to the housing 32 by journal 93 and an arm 120 which is engaged by push rod 88 at an end thereof. The cam follower also has a follower arm 122 having a primary cam engagement surface 124 which engages only the primary cam surface 110 of the cam 106. The cam follower 114 has an extension leg 126 which extends from the side of the cam follower arm 124 and has a secondary cam engagement surface 128 which is engageable with the boss 112 to disengage the primary cam engagement surface from engagement with the cam surface 110 during a predetermined rotational interval of the cam 106. The engagement of the secondary cam engagement surface with the boss 112 opens the intake valve for a predetermined portion of the compression cycle providing a compression relief reducing the cranking force on the cam shaft during cranking. As shown in FIG. 6, when the boss 112 of the cam 106 is in a region displaced from the secondary cam engagement surface 128, the primary cam engagement surface is in intimate contact with the primary cam surface 110 and the position of the input cam follower is determined by the profile of the cam 106 as in a conventional prior art engine. In this position, the extension leg 126 extends along the side of the cam 106.

Figure 7:
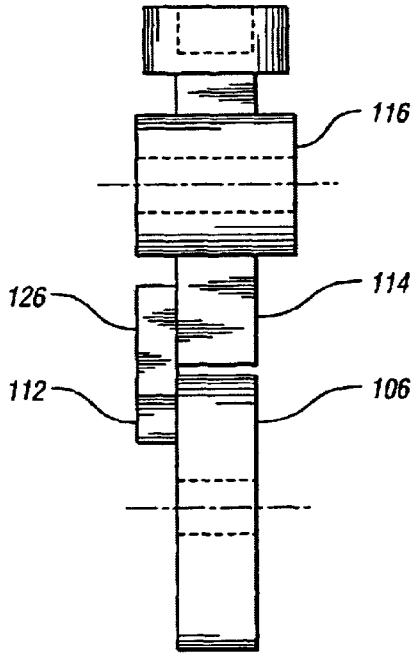
FIG. 7 is a schematic having the secondary cam engagement surface of the intake cam follower in contact with the second cam surface.

However, when the position of the cam 106 is such that the boss 112 is engaged by the secondary cam engagement surface 128 as shown in FIG. 7, the primary cam engagement surface 124 is displaced from the primary cam surface 110. This causes the intake valve cam follower to be rotated through a small angle activating the intake valve to remain slightly opened decreasing the pressure in the combustion chamber 44 as desired. The extended open period of the intake valve 50 during cranking results in only minimal degradation of engine performance when operating at higher engine speeds.

Figure 8A:
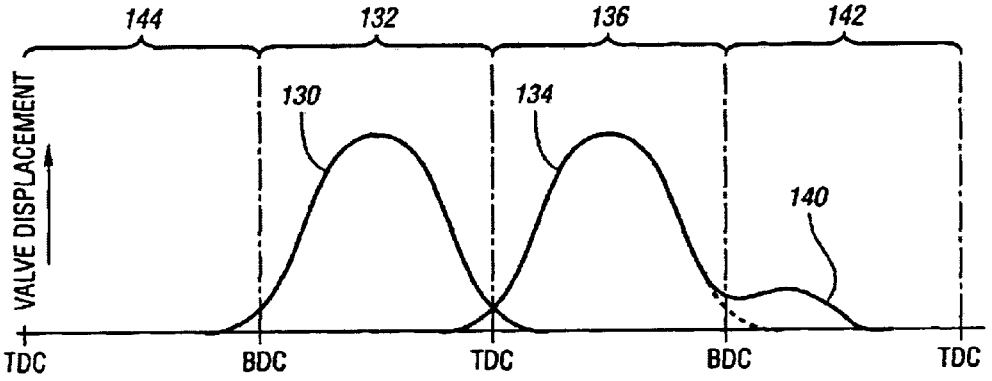
FIGS. 8*a* and 8*b* are graphs showing the displacement of the exhaust and intake valves during the four-cycles of the engine.

Since the exhaust cam follower does not have an extension leg comparable to extension leg 126, the exhaust cam follower is unaffected by the presence of the boss 112 and it operates in a normal manner. FIG. 8*a* is a graph showing the displacement of the exhaust valve, during the exhaust cycle 132 of the engine, curve 130, and the displacement of the intake valve 50, during the intake cycle 136 of the engine, curve 134. The portion of the curve 140 which is an extension of the curve 134 shows the continued opening of the intake valve during the compression cycle of the engine. The position of the intake valve 50 and the exhaust valve 56 during the combustion cycle remains the same as in prior art four-cycle internal combustion engines.

Figure 8B:
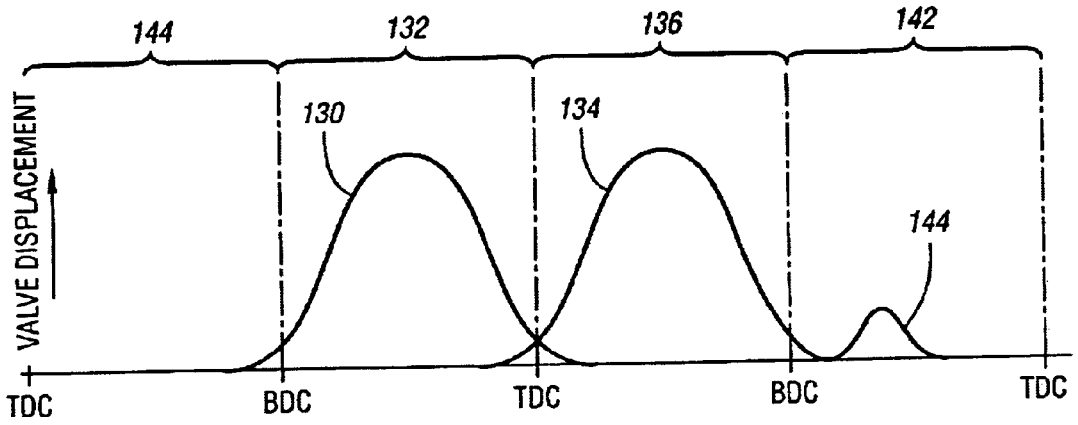

Although the invention has been described and illustrated showing the intake valve cam follower being actuated by the secondary cam surface, it would be obvious to one skilled in the art that the exhaust valve cam follower rather than the intake valve cam follower could have an extension leg comparable to extension leg 126 and a secondary cam engagement surface corresponding to secondary cam engagement surface 128 and the boss 112 being located such that the exhaust valve rather than the intake valve is opened for a predetermined period of the compression cycle as shown in FIG. 8*b*. This set of curves shows the temporary opening of the exhaust valve 56, curve 144, during the compression cycle 142. The invention contemplates opening either the intake valve or the exhaust valve for a short period of time during the compression cycle to provide the desired compression relief during cranking of the engine.

Figure 9:
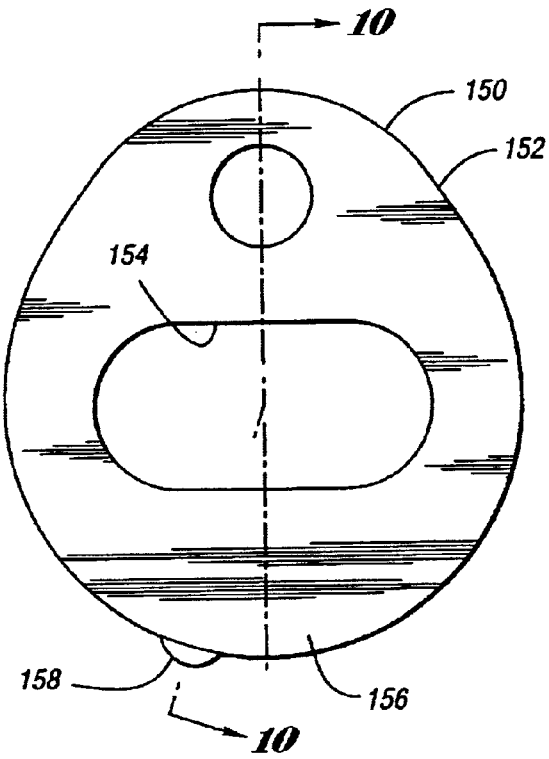
FIG. 9 is a front view of an alternate configuration of the cam.
Figure 10:
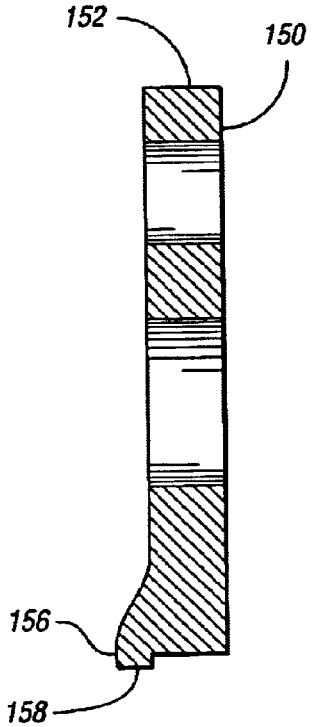
FIG. 10 is a cross-sectional side view of the cam shown on FIG. 8.
Figure 11:
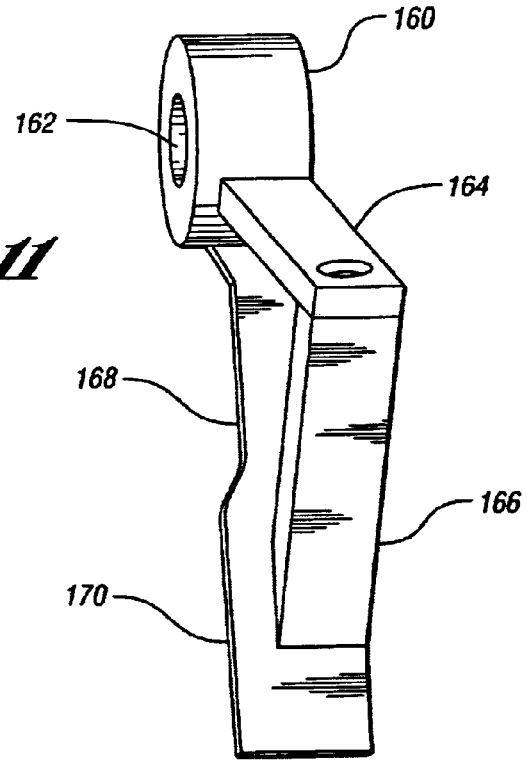
FIG. 11 is a perspective of a cam follower.

An alternate embodiment of the cam and the cam follower is shown on FIGS. 9 through 11. Referring first to FIGS. 9 and 10, the cam 150 corresponds to cam 86 shown on FIG. 3 and has a primary cam surface 152 and a mounting slot 154 which locks the rotation of the cam 150 to the rotation of the cam gear 82. The cam 150 further has an enlarged portion 16 which protrudes from one side of the cam 150. The peripheral surface of the enlarged portion 156 is a lateral extension of the cam surface 152. The enlarged portion 156 further includes radial protrusion or bump 158 which provides a secondary cam surface laterally displaced from the primary cam surface 152. The radial protrusion or bump 158 provides the secondary cam surface corresponding to the secondary cam surface provided by boss 112.

The cam valve follower 160 shown on FIG. 11 has a mounting bore 162 by means of which it is pivotably attached to the housing. The cam valve follower 150 has an arm 164 which is engaged by the exhaust or intake valve push rods 88 or 92 to open and close the exhaust and intake valves respectively. The cam follower 150 also has a follower arm 168 which engages the primary cam surface 152 of the cam 150. The width of the follower arm 168 at the end which engages the cam 150 is enlarged having a secondary cam engagement portion 170 which is capable of engaging the secondary cam surface of the radial protrusion 158. The cam 150 and cam follower 160 may be arranged to partially open the intake or exhaust valves during a predetermined portion of the compression cycle. The cam follower controlling the opening and closing of the valve not associated with cam follower 160 will not have a secondary cam engagement portion 170 and therefore will only follow the profile of the primary cam surface 152 and be unaffected by the secondary cam surface. The operation of this alternate embodiment is substantially the same as the embodiment shown on and discussed relative to FIGS. 4 through 8.

FIGS. 12 and 13 illustrate still another embodiment of the cam activating the intake and exhaust valves of the engine. In this embodiment, the cam 206 has a primary cam surface 208 which is engaged by both the intake valve cam follower 86 and the exhaust valve cam follower 90 to actuate the intake vale and exhaust valve respectively. The secondary cam surface 212 is provided on a secondary cam 210 slidably attached to cam 206. The secondary cam 210 has a cam shaft slot 216 through which the cam shaft 82 is received. The cam shaft slot 216 is arranged to permit radial displacement of the secondary cam 210 but the sides of the cam shaft slot 216 prohibits transverse displacement of the secondary cam 210. The end 214 of the secondary cam 210 opposite the secondary cam surface 212 functions as a weight which produces a force biasing the secondary cam surface 212 away from the primary cam surface 208 at normal engine operating speeds. A guide pin 222 attached to the primary cam 206 is received in a guide pin slot 220 and controls the orientation of the secondary cam relative to cam 206. The guide pin slot 220 is dimensioned such that when the secondary cam 210 is displaced as far as it can go radially away from the cam shaft 82, the secondary cam surface 212 is engageable by the secondary cam engagement surface 124 of the intake valve cam follower 114 to produce the desired compression relief. However, when the engine is running, the radial force generated by the weight at the opposite end 214 of the secondary cam 210 will radially displace the secondary cam 210 and the secondary cam surface 212 towards the cam shaft 82 a distance sufficient to prevent engagement of the secondary cam surface 112 by the secondary cam engagement surface of the intake cam follower 114. The secondary cam is biased away from the cam shaft 82 to its operative position by a spring 224. One end of the spring 224 is received in a spring bore 218 provided in the secondary cam and the other end of the spring 224 engages camshaft 82. The spring 224 is selected to have a force sufficient to maintain the secondary cam 210 in the extended position at cranking speeds of the cam shaft 82, but will permit the secondary cam 210 to be radially retracted at nominal engine speeds to prevent the engagement of the secondary cam surface 212 by the secondary cam engagement surface 128 of the intake cam follower 114. The radial length of the secondary cam is selected so that neither end is engageable by the secondary cam engagement surface 128 at normal operating rotational speeds of the engine.

The secondary cam 210 is slidably held against cam 206 by a conventional "C" washer received in an annular groove 228 provided in the cam shaft 82 as shown in FIG. 13.

As discussed above, the engagement of the secondary cam surface 212 by the secondary cam engagement surface 128 of the intake valve cam follower only produces compression relief during cranking of the engine. This mechanism is disabled by the withdrawal of the secondary cam by centrifugal force once the engine reaches a normal operating speed. Therefore, the compression relief is only obtained during cranking of the engine. As in previous embodiments, the secondary cam surface and secondary cam engagement surfaces may be arranged to open either the intake valve or exhaust valve during the compression cycle.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A mechanism for partially opening a selected one of the intake valve and the exhaust valve of a four cycle engine during the compression cycle, the engine having at least a cylinder provided with an intake valve and an exhaust valve, the mechanism comprising:

a cam having a primary cam surface and a secondary cam surface located on an integrally formed fixed boss displaced laterally to the side of the primary cam surface at a predetermined rotational orientation relative to the primary cam surface;

an exhaust valve cam follower disposed between the exhaust valve and the cam, the exhaust valve cam follower having a primary cam engagement surface engageable only with the primary cam surface, the exhaust valve cam follower oriented relative to the cam to open the exhaust valve during the exhaust cycle of the four-cycle engine;

an intake valve cam follower disposed between the intake valve and the cam, the intake valve cam follower having a primary cam engagement surface engageable only with the primary cam surface, the intake cam follower being oriented relative to the cam to open the intake valve during the intake cycle of the engine in response to the primary cam engaging surface engaging the primary cam surface;

wherein one of the intake valve and exhaust valve cam followers is provided with a secondary cam engagement surface displaced laterally to the side of the primary cam engagement surface and engageable with the secondary cam surface to partially open the associated valve causing the follower primary cam engagement surface to lift off of the primary cam engagement surface during at early portion of the compression cycle to provide compression relief at low speeds to facilitate easy cranking of the engine.

2. The mechanism of claim 1 wherein the primary and secondary cam engagement surfaces are radially displaced relative to each other.

3. The mechanism of claim 1 wherein the secondary cam engagement surface radial protrusion oriented lateral to and extending above the adjacent primary cam engagement surface.

4. A compression relief mechanism to facilitate the cranking of a four-cycle internal combustion engine having intake and exhaust valves actuated by a single cam comprising:

a cam having a primary cam surface and a secondary cam surface located on an integrally formed fixed boss displaced laterally to the side of the primary cam surface at a predetermined rotational orientation relative to the primary cam surface;

an exhaust valve cam follower disposed between the cam and the exhaust valve, the exhaust valve cam follower having a primary cam engagement surface for engaging the primary cam surface to cause the exhaust valve to open during an engine exhaust cycle; and an intake valve cam follower having a first cam engagement surface engageable only with the primary cam engagement surface to open the intake valve during an engine intake cycle, the intake cam follower further provided with a secondary cam engagement surface oriented laterally of the first cam engagement surface to engage the secondary cam surface to partially open the intake valve causing the follower cam surface to lift off of the primary cam engagement surface during an early stage of the compression cycle to provide compression relief at low engine speeds to facilitate easy cranking of the engine during starting.

5. The compression relief mechanism of claim 4 wherein the secondary cam engagement surface is displaced radially from the primary cam engagement surface.

6. The compression relief mechanism of claim 4 wherein the secondary cam surface is displaced radially inwardly from the primary cam surface and the second cam engagement surface extends from the first cam engagement surface along the side of the cam.

* * * * *